US005619823A

United States Patent [19]

Ruff et al.

[11] Patent Number: 5,619,823

[45] Date of Patent: Apr. 15, 1997

[54] PRE-FINISHED METAL DOOR FRAME

[75] Inventors: Robert O. Ruff, Cincinnati; Donald L. King, Loveland, both of Ohio

[73] Assignee: Ingersoll-Rand Co., Phillipsburg, N.J.

[21] Appl. No.: 499,604

[22] Filed: Jul. 11, 1995

[51] Int. Cl.[6] ..... E06B 1/18

[52] U.S. Cl. ..... 49/504; 52/210; 52/211; 52/656.2; 52/656.4; 403/270; 403/363

[58] Field of Search ..... 52/210, 211, 656.2, 52/656.4; 49/504, 505; 403/382, 401, 363, 270, 271

[56] References Cited

U.S. PATENT DOCUMENTS

| | | | |
|---|---|---|---|
| 3,248,833 | 5/1966 | Sklar . | |
| 3,385,004 | 5/1968 | Oehler et al. . | |
| 3,999,339 | 12/1976 | Sappenfield | 52/210 X |
| 4,223,494 | 9/1980 | Wendt . | |
| 4,226,066 | 10/1980 | Persson . | |
| 4,442,644 | 4/1984 | Jukes . | |
| 4,513,549 | 4/1985 | Wendt . | |
| 4,719,729 | 1/1988 | Wynar . | |
| 4,829,727 | 5/1989 | Kuzara, Jr. | 52/127.2 |
| 4,873,804 | 10/1989 | Kukke . | |
| 5,136,822 | 8/1992 | Blum . | |
| 5,203,132 | 4/1993 | Smolik . | |
| 5,295,327 | 3/1994 | Dubois . | |
| 5,357,725 | 10/1994 | Ferry . | |

OTHER PUBLICATIONS

"Steel Dorrs, Frame and Entrance Systems", 08100 STC, BuyLlne 0020, Steelcraft, pp. 1–7. Aug. 1993.

"Nomenclature for Steel Doors and Steel Door Frames", ANSI/SDI A123.1—1989, American National Standards Institute, Inc. pp. 1–17. 1989.

"The Standard Steel Door and Frame Story", Steel Door Institute, pp. 1–12. Jul. 1994.

"K. D. Frame Assembly And Installation For Open Steel Stud", No. 2006, Rev. Jul. 1980, Steelcraft.

*Primary Examiner*—Christopher Todd Kent
*Attorney, Agent, or Firm*—Steven J. Rosen

[57] ABSTRACT

A metallic frame and, more particularly, a stainless steel door frame has a bent sheet metal frame element encompassing an inner space and the element has backbends which extend perpendicularly inward from the back ends of faces of the element. At least one slidably insertable sleeve is disposed inside the element and has flanges which are spot welded to the back ends. The sleeves serve as carriers for various door hardware such as hinge reinforcement and strike plates, clips having bendable tabs, and anchors.

22 Claims, 4 Drawing Sheets

PRE-FINISHED METAL DOOR FRAME

BACKGROUND OF THE INVENTION

1. Field of the Invention

The present invention pertains to metal frames and frame assemblies for doors or other casings and, in particular, to a means for mounting hardware in the interior of jambs and/or headers of metal door frames constructed from pre-finished metal such as prepolished stainless steel.

2. Description of Related Art

The field of the present invention is the art of metal frames for openings, such as doors in buildings and the invention may also be applied to window frames and casings as well. This invention relates to hollow sheet metal frames which can be easily installed by workmen in openings, such as the doorway in a new or an existing wall of a building. Typically simple tools, for example, a hammer, level, a square and screw driver are used for assembly installation. The frames may be delivered either assembled or in knockdown condition for field assembly at the job site. More particularly, this invention relates to hollow stainless steel sheet metal frames which are installed in openings, such as the doorway in a new or an existing wall of a building. Stainless steel is a highly desirable material for use in frames for doors and the like in building interiors. However, stainless steel is an expensive material and difficult and expensive to fabricate. Door frames have many pieces of hardware mounted in the interior of the frame and attached, usually by welding to, rabbets and faces of the door frame. The welds leave marks and blemishes on the outside of the frame which, particularly, for stainless steel frames must be removed, such as by polishing. This is a labor intensive process which increases the manufacturing cost of the frame. Therefore, there is a need for a door frame which eliminates and/or reduces the need for this polishing step.

SUMMARY OF THE INVENTION

A metal frame member having a bent sheet metal frame element encompassing an inner space. The frame element includes a soffit spaced apart from and generally parallel to a rabbet, a stop extending substantially perpendicular to and between the rabbet and the soffit, a face extending perpendicularly from the rabbet away from the soffit to a back end of the face, and a backbend extending perpendicularly inward from the back end of the face so as to be generally parallel to the rabbet and bordering the inner space. Disposed in the frame element is at least one slidably insertable sleeve having a front wall, a side wall extending perpendicularly inward away from the front wall towards the backbend, and a flange extending perpendicularly from the side wall and bonded to the backbend. The flange is bonded to the backbend by a welding means and, preferably, by a plurality of spot welds. The present invention is particularly useful for a sheet metal frame which is made of prepolished stainless steel.

A more particular embodiment of the invention has a metal frame member which is a double rabbet jamb, which includes, a sheet metal frame element having left and right rabbets, respectively spaced apart from and generally parallel to the soffit, a left stop extends substantially perpendicular to and between the left rabbet and the soffit, a right stop extending substantially perpendicular to and between the right rabbet and the soffit, a left face extending perpendicularly from the left rabbet away from the soffit to a back end of the left face, a right face extending perpendicularly from the right rabbet away from the soffit to a back end of the right face, a left backbend extending perpendicularly from the back end of the left face so as to be generally parallel to the left rabbet and bordering the inner space, and a right backbend extending perpendicularly from the back end of the right face so as to be generally parallel to the right rabbet and bordering the inner space. Disposed in the frame element is a slidably insertable sleeve having a front wall, right and left side walls extending perpendicularly inward away from right and left ends of the front wall towards the backbend, and right and left flanges extending perpendicularly from corresponding ones of the right and left side walls, and the right and left flanges are correspondingly bonded to the right and left backbend, respectively.

Different types of and multiple sleeves may used in a single jamb. The sleeve my have one or more bendable tabs extending upward from the front and/or the side walls in a lengthwise direction of the jamb. Another sleeve may have a hinge reinforcement plate which covers a hinge cutout in the jamb. Another sleeve may have a strike plate which covers a strike cutout in the jamb. Yet another sleeve may have a base anchor located at a base end of the jamb.

ADVANTAGES

Among the advantages provided by the present invention is a better metal door frame that is particularly useful for indoor door frames, particularly, those made of stainless steel or having other final finishes applied to the outer surfaces such as paint. The stainless steel door frame of the present invention does not require as much work and/or processes to manufacture as those of the prior art. The stainless steel door frame of the present invention does not require as much, if any, polishing of the weld marks because they are hardly in view and, therefore, not visible to people passing through the door frame. Therefore, the spot weld marks are not an architectural eyesore that detracts from the aesthetic appeal of the doorway. The frame of the present invention is easier and less costly to manufacture and provides a door frame that is as architecturally and aesthetic appealing as frames found in the prior art. The frames of the present invention my be surface finished in a factory under controlled conditions and delivered either assembled or knockdown condition ready for installation.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
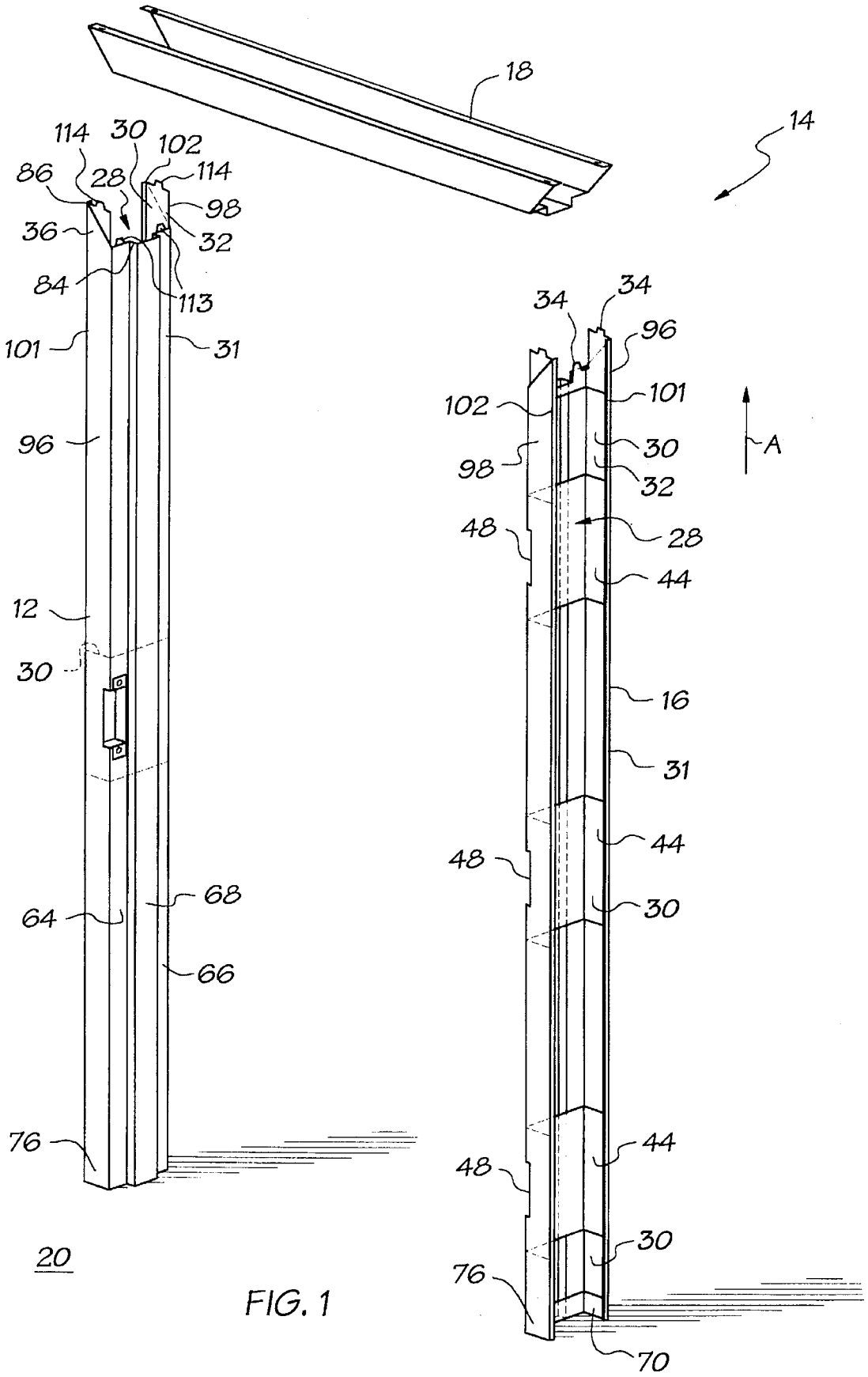
FIG. 1 is a perspective exploded view illustrating an exemplary embodiment of a metal door frame in accordance with the present invention.

FIG. 1 illustrates in an exploded view, a pre-finished metal door frame 14 having a header 18 which attaches to opposing door jambs, a hinge jamb 16 ad a strike jamb 12, the header and jambs are also referred to in this patent application as frame members of the frame 14. The pre-finished metal door frame 14 is constructed from an assembly illustrated herein as having a pair of opposed hinge and strike jambs 16 and 12, respectively connected by the header 18 and resting on a floor 20 between typically masonry walls (not shown) that extend upward from the floor. The present invention was developed for a stainless steel metal door frame 14 but may also be used for frames having other finishes such as paint. The nomenclature used herein is well known in the industry and essentially described in greater detail in the reference "Nomenclature for Steel Doors and Steel Door Frames" published by the Steel Door Institute and approved by the American National Standards Institute and is used herein as a standardized reference for all terms and nomenclature where applicable.

The present invention provides a means for attaching a sleeve 30 that serves as a carrier for hardware used in the door frame 14. The sleeve 30 is slidable in a bent sheet metal frame element 31 which encompasses an inner space 28 of a frame member such as the strike jamb 12, hinge jamb 16 of the frame 14, or the header 18. The invention was particularly developed for a frame element 31 constructed from prepolished stainless steel but the invention may be used with other finished metal frames. Many types of hardware are used on a typical metal door frame and are usually located in both the strike jamb 12 and hinge jamb 16 of the frame 14 and the present invention provides more particular types of sleeves 30.

Figure 2:
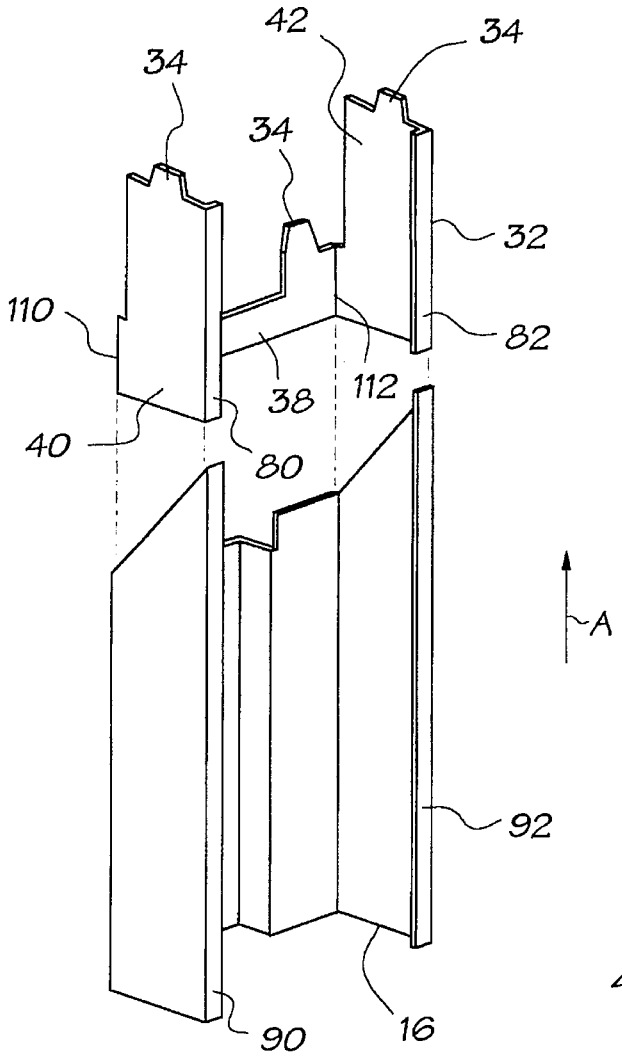
FIG. 2 is an enlarged exploded view of a clip sleeve for use in a jamb of the corner of the door frame in FIG. 1.
Figure 3:
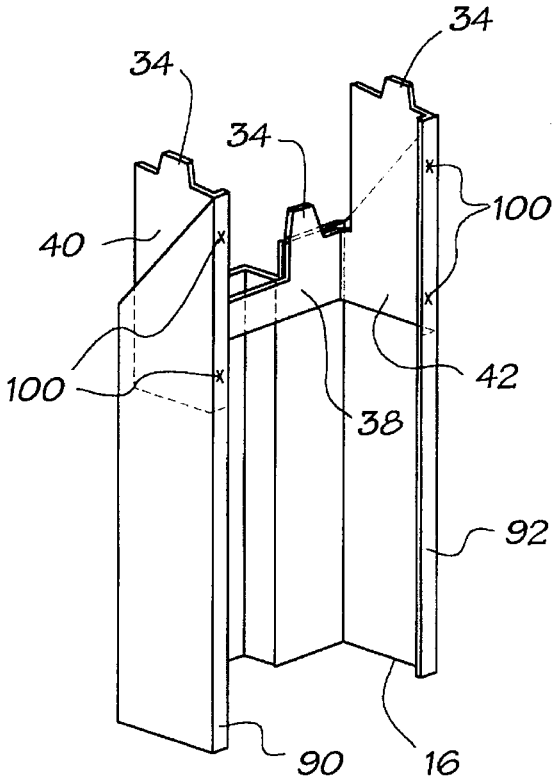
FIG. 3 is an enlarged view of the clip sleeve in FIG. 2 spot welded to the jamb of the door frame in accordance with the present invention.

Further illustrated in FIGS. 2 and 3 is a more particular type of slidably insertable sleeve, clip sleeves 32 are disposed at top ends 36 of the strike jamb 12 and the hinge jamb 16 for securing the jambs to the header. The clip sleeves 32 have one or more bendable tabs 34. Two each are illustrated extending upward from a front wall 38 and/or left and right side walls 40 and 42, respectively of the clip sleeve 32 in a lengthwise direction of the strike jamb 12 (as illustrated in FIG. 1) and hinge jamb 16 of the frame 14. The exemplary embodiment illustrated herein has 4 bendable tabs 34, two extending upward from each of the front wall 38 and left and right side walls 40 and 42, that are adapted to be disposed through slots (not shown) in the header 18 and bent over to secure the header 18 to each of the hinge jamb 16 and the strike jamb 12. The left and right side walls 40 and 42, respectively, extend perpendicularly away from right and left edges 110 and 112, respectively of the front wall 38 towards corresponding ones of left and right backbends 90 and 92 respectively of the jambs 12 and 16. Left and right flanges 80 and 82 respectively extend perpendicularly from corresponding ones of the left and right side walls 40 and 42 respectively and the right and left flanges are spot welded to corresponding ones of the right and left backbends, 90 and 92 respectively. In the exemplary embodiment illustrated herein, the clip sleeve 32 serves to carry or support a pair of first bendable tabs 113 which extend upward from the front wall 38 and a pair of second bendable tabs 114, each one of which extend upward from one the left or right side walls 40 and 42, respectively in a lengthwise direction, denoted by the arrow labelled A, of the hinge jamb 16. Note that more bendable tabs my be used.

Figure 4:
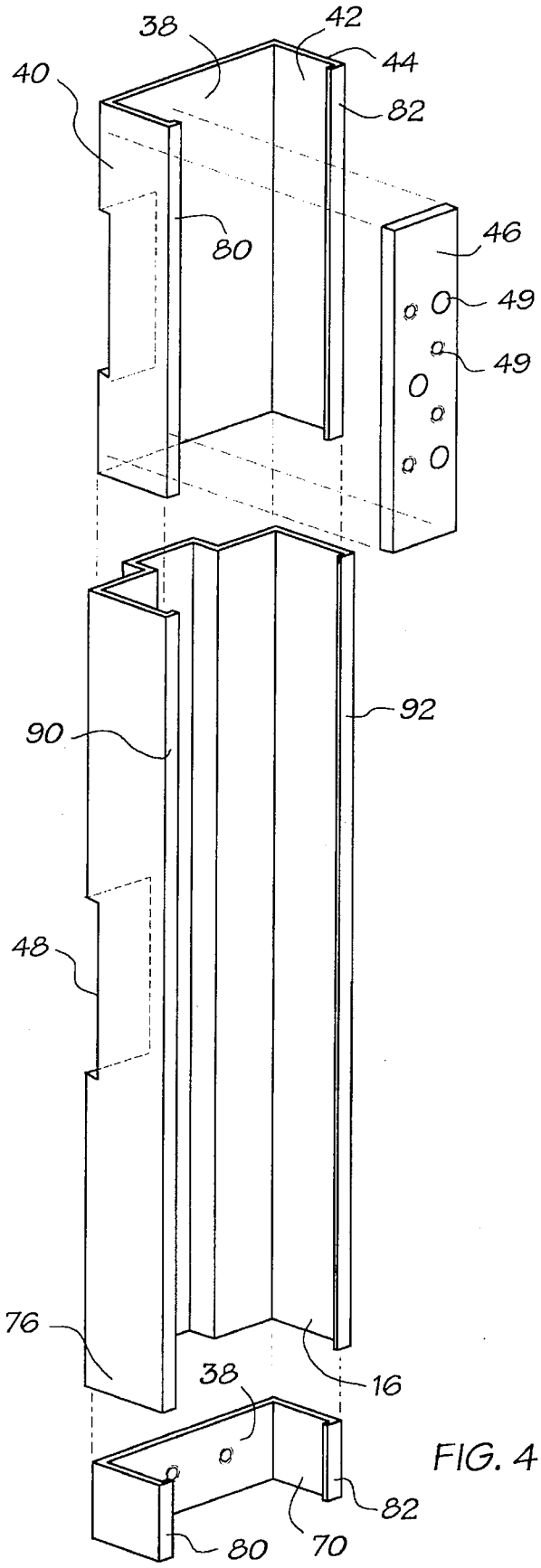
FIG. 4 is an enlarged exploded view of a hinge sleeve and a base anchor sleeve for use in a jamb of the door frame in FIG. 1.
Figure 5:
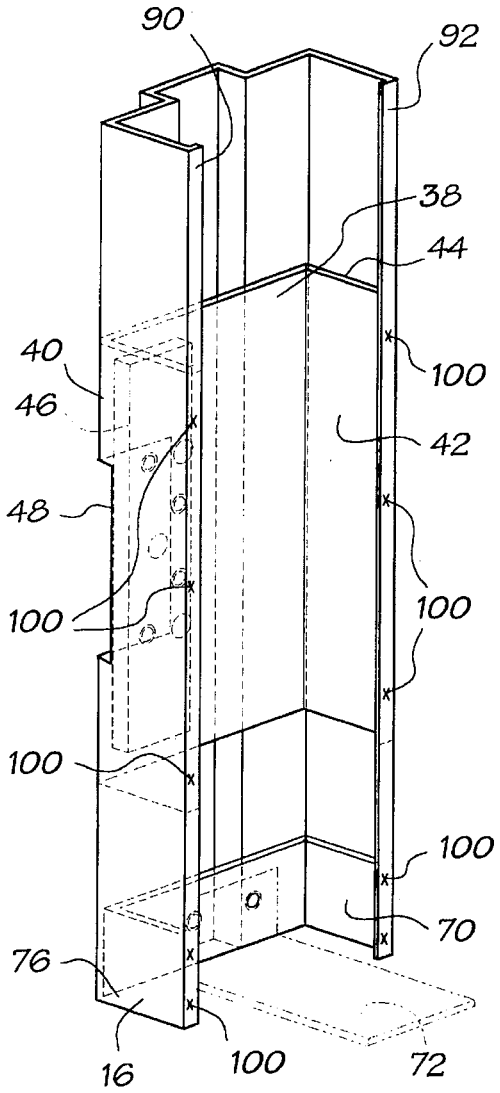
FIG. 5 is an enlarged view of the hinge sleeve and the base anchor sleeve with a base anchor in FIG. 4 spot welded to the jamb of the door frame in accordance with the present invention.

Further illustrated in FIGS. 4 and 5 is another more particular type of slidably insertable sleeve, a hinge sleeve 44 which provides hinge reinforcement and may serve as a carrier for a hinge reinforcement plate 46 which covers a hinge cutout 48 in hinge jamb 16 of the frame 14. The hinge reinforcement plate 46 typically has pre-drilled hinge mounting holes 49 which may be of different sizes to accommodate different types and sizes of bolts. The hinge reinforcement plate 46 my be welded, screwed, bolted, or otherwise mounted and secured to hinge sleeve 44. Also illustrated in FIGS. 4 and 5 is another more particular type of slidably insertable sleeve, an anchor sleeve 70 which has base anchors 72 at base ends 76 of the strike jamb 12 and hinge jamb 16 of the frame 14. The base anchors 72 are used to anchor and secure the frame 14 to the floor 20 and/or masonry or other types of walls.

Figure 6:
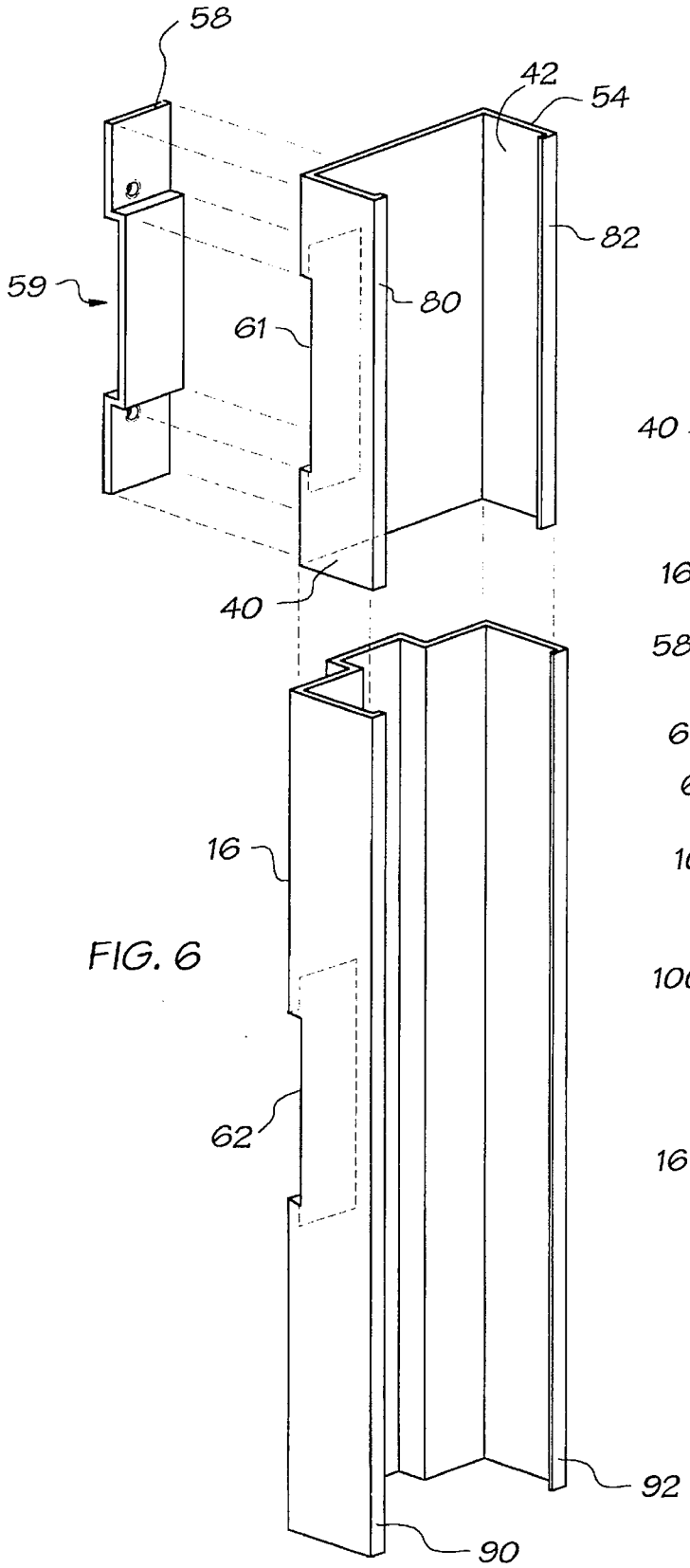
FIG. 6 is an enlarged exploded view of a strike cutout and a strike plate mounted on a strike sleeve for use in a jamb of the door frame in FIG. 1.
Figure 7:
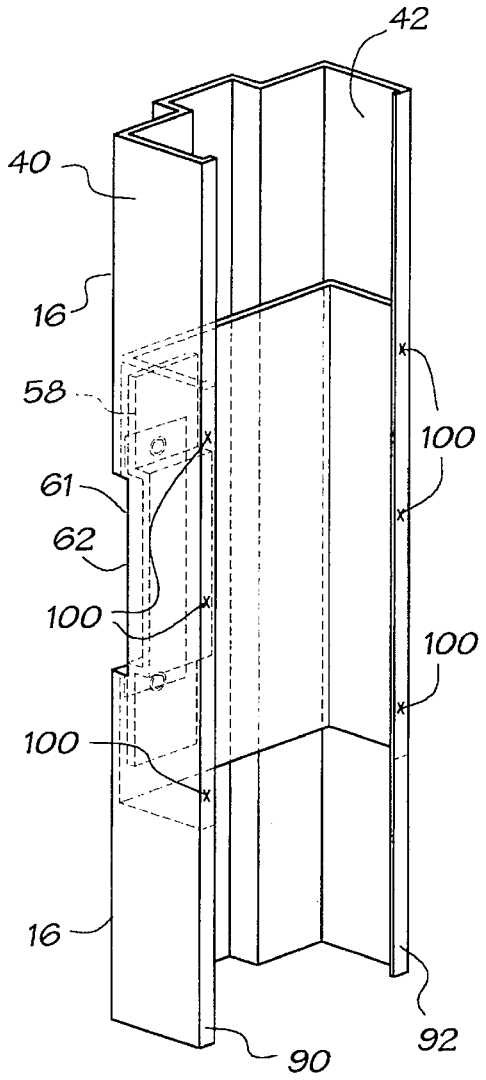
FIG. 7 is an enlarged view of the strike cutout and the strike plate and strike sleeve in FIG. 6 spot welded to the jamb of the door frame in accordance with the present invention.

Further illustrated in FIGS. 6 and 7 is another more particular type of slidably insertable sleeve, a strike sleeve 54 having a strike, illustrated in its preferred embodiment as a strike plate 58, with a cup 59, that is mounted on the strike sleeve 54 and the strike plate covers a first strike cutout 61 and a second strike cutout 62 in the strike jamb 12.

All of the sleeves have left and right flanges 80 and 82, respectively distally located from the front walls 38 and that are perpendicular to the corresponding left and right side walls 40 and 42, respectively of the sleeves. The left and right flanges 80 and 82, respectively are attached to and, preferably, bonded to the left and right backbends 90 and 92, respectively of the jambs 12 and 16. Welding is the preferred method of bonding and tack or spot welds 100 are particularly useful and easy to incorporate in the on-site construction of the door frame 14. The invention was particularly developed for a frame element 31 constructed from prepolished stainless steel so that the spot welding of the left and right flanges 80 and 82, respectively to the left and right backbends 90 and 92, respectively would not be in view and would require no or little dressing or polishing of the spot welds afterwards. Left and right faces 96 and 98 of the frame element 31 are directly in view of people passing through the frame 14 and are spared from being marred or otherwise blemished by the present invention unlike frames of the prior art which would then require expensive dressing or polishing to hide the spot weld marks or blemishes caused by the welding.

Note that the exemplary embodiment of the invention illustrated in FIGS. 1–7 is for a double rabbet jamb shown for both the hinge and strike jambs 16 and 12, respectively but, the invention may be used for single rabbet jambs as well. The sheet metal frame element 31 of the double rabbet hinge and strike jambs 16 and 12 has left and right rabbets 64 and 66, respectively. The left and right rabbets 64 and 66 spaced apart from and generally parallel to a soffit 68 and a left stop 84 extends substantially perpendicular to and between the left rabbet 64 and the soffit and a right stop 86 extends substantially perpendicular to and between the right rabbet 66 and the soffit. The left face 96 extends perpendicularly from the left rabbet 64 away from the soffit 68 to a left back end 101 of the left face. The right face 98 extends perpendicularly from the right rabbet 66 away from the soffit 68 to a right back end 102 of the right face. The left backbend 90 extends perpendicularly from the left back end 101 so as to be generally parallel to the left rabbet 64 and borders the inner space 28. The right backbend 92 extends perpendicularly from the right back end 102 of the right face 98 so as to be generally parallel to the right rabbet 66 and borders the inner space 28.

While the preferred embodiment of the present invention has been described fully in order to explain its principles, it is understood that various modifications or alterations may be made to the preferred embodiment without departing from the scope of the invention as set forth in the appended claims.

We claim:

1. A metal frame member comprising;

a bent sheet metal frame element encompassing an inner space and having a soffit spaced apart from and generally parallel to a rabbet and a stop extending substantially perpendicular to and between said rabbet and said soffit;

a face extending perpendicularly from said rabbet away from said soffit to a back end of said face;

a backbend extending perpendicularly inward from said back end of said face so as to be generally parallel to said rabbet and bordering said inner space;

a slidably insertable sleeve disposed in said frame element;

said sleeve having a front wall, a side wall extending perpendicularly inward away from said front wall towards said backbend, and a flange extending perpendicularly from said side wall; and said flange is bonded to said backbend.

2. A metal frame member as claimed in claim 1 wherein said flange is bonded to said backbend by a welding means.

3. A metal frame member as claimed in claim 2 wherein said welding means is a plurality of spot welds.

4. A metal frame member as claimed in claim 3 wherein said sheet metal frame element is made of stainless steel.

5. A metal frame member as claimed in claim 3 wherein the metal frame member is a double rabbet jamb and said sheet metal frame element comprises;

left and right rabbets respectively spaced apart from and generally parallel to said soffit;

a left stop extending substantially perpendicular to and between said left rabbet and said soffit;

a right stop extending substantially perpendicular to and between said right rabbet and said soffit;

a left face extending perpendicularly from said left rabbet away from said soffit to a back end of said left face;

a right face extending perpendicularly from said right rabbet away from said soffit to a back end of said right face;

a left backbend extending perpendicularly from said back end of said left face so as to be generally parallel to said left rabbet and bordering said inner space;

a right backbend extending perpendicularly from said back end of said right face so as to be generally parallel to said right rabbet and bordering said inner space;

a slidably insertable sleeve disposed within said frame element;

said sleeve having a front wall, right and left side walls extending perpendicularly inward away from right and left ends of said front wall towards said backbend, and right and left flanges extending perpendicularly from corresponding ones of said right and left side walls; and said right and left flanges are correspondingly bonded to said right and left backbend respectively.

6. A metal frame member as claimed in claim 5 wherein said sleeve further comprises at least one bendable tab extending upward from one of said front and said side walls in a lengthwise direction of said jamb.

7. A metal frame member as claimed in claim 6 wherein said sleeve further comprises two first bendable tabs extending upward from said front wall and two second bendable tabs each of which extends upward from one of said side walls in a lengthwise direction of said jamb.

8. A metal frame member as claimed in claim 7 wherein said sleeve is adapted for a mitered end of said jamb wherein said faces have a mitered cut and said side walls extend higher than said front wall and said two second bendable tabs begin and terminate higher with respect to said sleeve than said two first bendable tabs in said a lengthwise direction of said jamb.

9. A metal frame member as claimed in claim 5 further comprising;

a hinge cutout in said jamb, wherein said front wall includes a hinge reinforcement plate which covers said hinge cutout.

10. A metal frame member as claimed in claim 9 wherein said hinge reinforcement plate comprises a metal reinforcement plate bonded to said front wall.

11. A metal frame member as claimed in claim 5 further comprising;

a strike cutout in said jamb, wherein said front wall includes a strike plate which covers said strike cutout.

12. A metal frame member as claimed in claim 11 wherein said hinge reinforcement plate comprises a metal strike plate bonded to said front wall.

13. A metal frame member as claimed in claim 5 wherein said sleeve includes a base anchor which is located at a base end of said jamb.

14. A metal frame member as claimed in claim 5 wherein said sheet metal frame is made of stainless steel.

15. A metal frame member as claimed in claim 14 wherein said sleeve further comprises at least one bendable tab extending upward from one of said front and said side walls in a lengthwise direction of said jamb.

16. A metal frame member as claimed in claim 15 wherein said sleeve further comprises two first bendable tabs extending upward from said front wall and two second bendable tabs each of which extends upward from one of said side walls in a lengthwise direction of said jamb.

17. A metal frame member as claimed in claim 16 wherein said sleeve is adapted for a mitered end of said jamb wherein said faces have a mitered cut and said side walls extend higher than said front wall and said two second bendable tabs begin and terminate higher with respect to said sleeve than said two first bendable tabs in said a lengthwise direction of said jamb.

18. A metal frame member as claimed in claim 14 further comprising;

a hinge cutout in said jamb, wherein said front wall includes a hinge reinforcement plate which covers said hinge cutout.

19. A metal frame member as claimed in claim 18 wherein said hinge reinforcement plate comprises a metal reinforcement plate bonded to said front wall.

20. A metal frame member as claimed in claim 14 further comprising;

a strike cutout in said jamb, wherein said front wall includes a strike plate which covers said strike cutout.

21. A metal frame member as claimed in claim 20 wherein said strike plate comprises a metal strike plate bonded to said front wall.

22. A metal frame member as claimed in claim 14 wherein said sleeve includes a base anchor which is located at a base end of said jamb.

* * * * *